US012108845B2

(12) United States Patent
Hatano et al.

(10) Patent No.: US 12,108,845 B2
(45) Date of Patent: Oct. 8, 2024

(54) LAST

(71) Applicant: ASICS CORPORATION, Kobe (JP)

(72) Inventors: Genki Hatano, Kobe (JP); Yuya Kozuka, Kobe (JP); Shingo Takashima, Kobe (JP); Naoto Iwashita, Kobe (JP); Kei Kanematsu, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 18/048,607

(22) Filed: Oct. 21, 2022

(65) Prior Publication Data

US 2023/0129993 A1 Apr. 27, 2023

(30) Foreign Application Priority Data

Oct. 22, 2021 (JP) ..... 2021-173322

(51) Int. Cl.
*A43D 3/02* (2006.01)
*A43D 3/14* (2006.01)

(52) U.S. Cl.
CPC ..... *A43D 3/02* (2013.01); *A43D 3/027* (2013.01); *A43D 3/028* (2013.01); *A43D 3/1433* (2013.01); *A43D 3/1441* (2013.01); *A43D 3/145* (2013.01)

(58) Field of Classification Search
CPC ..... A43D 3/02; A43D 3/027; A43D 3/028; A43D 3/1433; A43D 3/1441; A43D 3/145
USPC ..... 12/133 R
See application file for complete search history.

(56) References Cited

U.S. PATENT DOCUMENTS 327,538 A * 10/1885 Dodsworth ..... A43D 3/1433 12/114.2
549,480 A * 11/1895 Adler ..... A43D 3/027 12/133 B
1,059,082 A * 4/1913 Simmons ..... A43D 3/02 12/146 L
1,565,057 A 12/1925 Frederick
2,538,247 A * 1/1951 Wormald ..... A43D 3/1433 12/114.4

(Continued)

FOREIGN PATENT DOCUMENTS

CN 109732913 A 5/2019
EP 3 900 568 A1 10/2021

(Continued)

OTHER PUBLICATIONS

English Translation of WO-2007012709-A1 (Year: 2007).*

(Continued)

*Primary Examiner* — Alissa J Tompkins
*Assistant Examiner* — Dakota Marin
(74) *Attorney, Agent, or Firm* — Studebaker & Brackett PC

(57) ABSTRACT

A last includes a base part including a bottom and a plurality of additional parts, each of which is formed in a plate shape and is capable of being assembled to the base part. The base part includes a mounting unit and a first forming surface. The plurality of additional parts include a second forming surface. Each additional part has an end face. The second forming surface includes the end face of each of the plurality of additional parts. The base part includes a first base member including a mounting unit and a second base member attachable to and detachable from the first base member.

6 Claims, 22 Drawing Sheets

(56) References Cited

U.S. PATENT DOCUMENTS

| | | | | | |
|---|---|---|---|---|---|
| 3,521,315 | A * | 7/1970 | Chatzimikes | A43D 3/027 | 12/136 R |
| 4,094,030 | A * | 6/1978 | Saad | A47G 25/005 | 211/38 |
| 6,000,081 | A * | 12/1999 | Sheridan | A43D 3/14 | 12/146 L |
| 8,418,267 | B2 * | 4/2013 | Shaw | G06Q 99/00 | 40/586 |
| 11,439,205 | B2 * | 9/2022 | Lu | A43D 3/1408 | |
| 11,547,181 | B2 * | 1/2023 | Kozuka | A43D 3/027 | |
| 2003/0041367 | A1 * | 3/2003 | Hadden | A42B 1/0182 | 2/195.5 |
| 2006/0168742 | A1 * | 8/2006 | Chang | A43D 3/1475 | 12/115.8 |
| 2016/0206049 | A1 | 7/2016 | Kallayil | | |
| 2018/0014609 | A1 | 1/2018 | Bruce et al. | | |
| 2020/0113291 | A1 * | 4/2020 | Smith | A43D 3/027 | |

FOREIGN PATENT DOCUMENTS

| | | | | |
|---|---|---|---|---|
| EP | 3 900 569 | A1 | 10/2021 | |
| EP | 4 018 872 | A1 | 6/2022 | |
| WO | WO-2007012709 | A1 * | 2/2007 | A43D 3/1483 |

OTHER PUBLICATIONS

The extended European search report issued by the European Patent Office on Feb. 23, 2023, which corresponds to European Patent Application No. 22197318.3-1015 and is related to U.S. Appl. No. 18/048,607.

* cited by examiner

LAST

This nonprovisional application is based on Japanese Patent Application No. 2021-173322 filed on Oct. 22, 2021 with the Japan Patent Office, the entire contents of which are hereby incorporated by reference.

BACKGROUND OF THE INVENTION

Field of the Invention

This disclosure relates to a last.

Description of the Background Art

When shoes are produced, a last (shoe tree) with which fabric constituting an upper is covered is used in order to form the upper into a predetermined shape.

US 2018/0014609 discloses manufacturing footwear in a portable housing. US 2016/0206049 discloses a last preform that can be reshaped by a shape memory polymer. CN 109732913 discloses forming a last by 3D printing.

SUMMARY OF THE INVENTION

When the whole custom-made last is manufactured in order to form a forming surface according to a shape of a foot of a wearer, it takes time to manufacture the last.

On the other hand, regarding the shape of the foot, it is known that areas where the differences between wearers are relatively small and areas where the differences between wearers are relatively large exist. Accordingly, the shape of the areas having relatively small differences for each wearer is constituted of invariable (common) parts, the shape of the areas having relatively large differences for each wearer is constituted of variable (tailor-made) parts, and by combining invariable (common) parts and variable (tailor-made) parts, it is possible to form an arbitrary forming surface according to the shape of the wearer's foot in a relatively simple manner.

However, after the upper is formed using such the last, sometimes it is difficult to take out the last from a wearing opening of the upper.

An object of the present disclosure is to provide a last that can relatively easily form an arbitrary forming surface and that is easily taken out from the wearing opening of the upper after forming of the upper.

A last according to one aspect of the present disclosure is a last including an upper forming surface for forming an upper including a wearing opening, the last including: a base part that includes a bottom defining a bottom surface of the upper; and a plurality of additional parts each of which is formed in a plate shape and is capable of being assembled to the base part, in which the base part includes: a mounting unit that mounts the plurality of additional parts such that the plurality of additional parts are arranged in a multi-layered form along one direction; and a first forming surface that defines a first region of the upper forming surface, the plurality of additional parts include a second forming surface defining a second region different from the first region in the upper forming surface while being attached to the mounting unit, each additional part in the plurality of additional parts has an end face, the second forming surface includes the end face of each of the plurality of additional parts, and the base part includes: a first base member that includes the mounting unit; and a second base member attachable to and detachable from the first base member.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
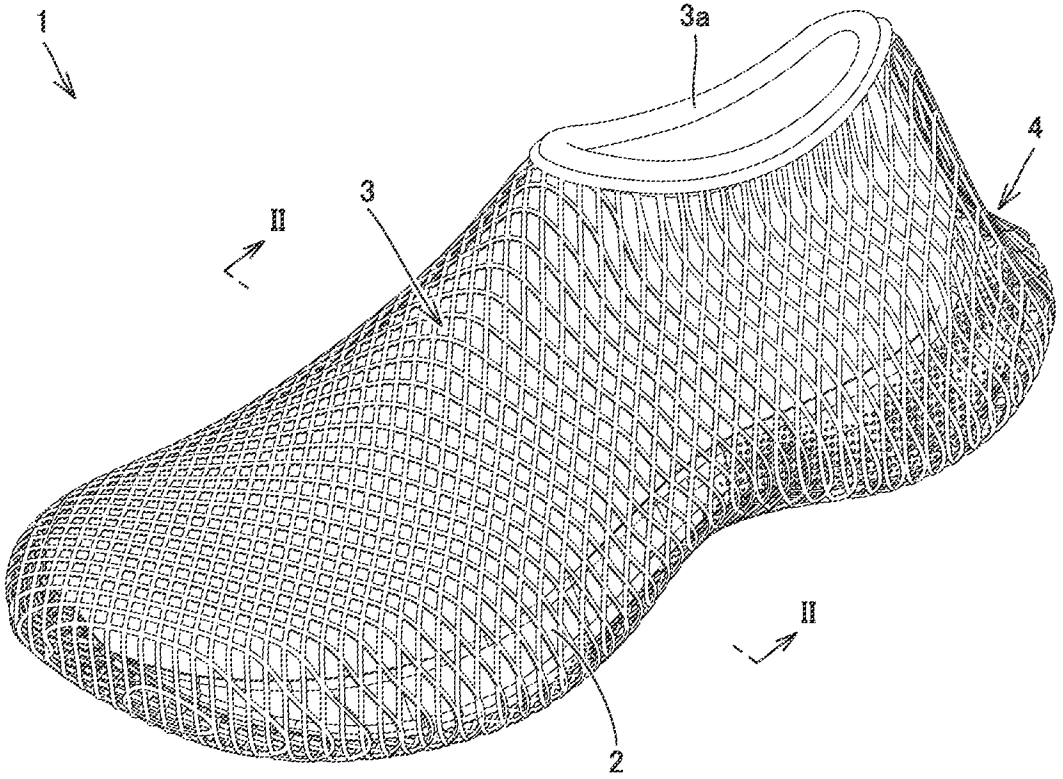
FIG. 1 is a perspective view illustrating a shoe made using a last according to an embodiment of the present disclosure.

An embodiment of the present invention will be described with reference to the drawings. In the drawings referred to below, the same or corresponding member is denoted by the same reference numeral. In the following description, terms such as a foot length direction, a foot width direction, a front side, and a rear side are used. The terms indicating these directions indicate directions as viewed from the viewpoint of the wearer wearing a shoe 1 placed on a flat surface such as the ground. For example, the front side refers to a toe side and the rear side refers to a heel side.

Figure 2:
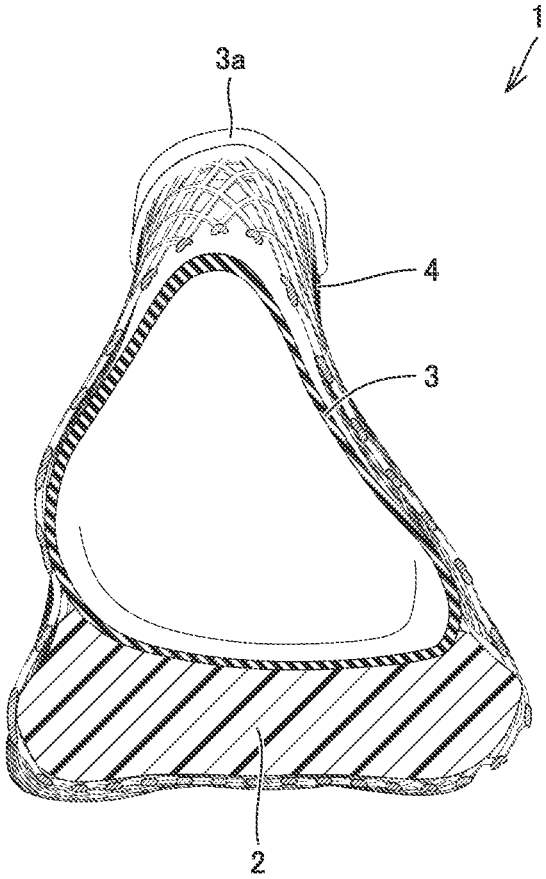
FIG. 2 is a sectional view taken along a line II-II in FIG. 1.
Figure 3:
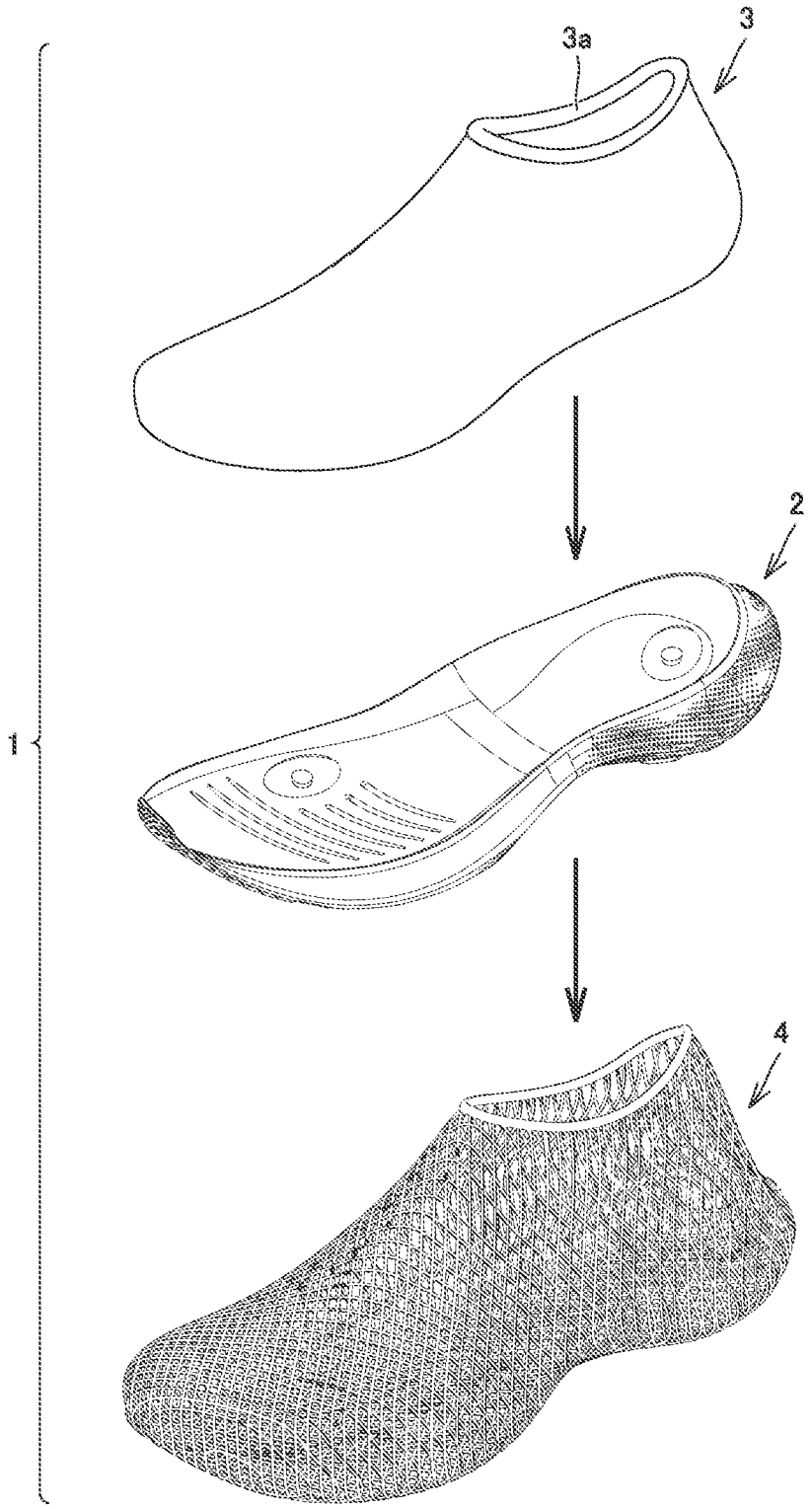
FIG. 3 is an exploded perspective view of the shoe.

FIG. 1 is a perspective view illustrating the shoe made using a last according to an embodiment of the present disclosure. FIG. 2 is a sectional view taken along a line II-II in FIG. 1. FIG. 3 is an exploded perspective view of the shoe. FIGS. 1 to 3 illustrate the shoe 1 for a left foot, but the shoe 1 can also be applied to a right foot. The shoe for the right foot has a bilaterally symmetrical shape with the shoe 1 for the left foot or a shape substantially similar thereto. For example, the shoe 1 can be applied as a sports shoe such as running or a walking shoe, but a use of the shoe 1 is not limited.

As illustrated in FIGS. 1 to 3, the shoe 1 includes a sole 2, an upper 3, and a shell 4.

The sole 2 is formed of a resin foam material or the like. The upper 3 is disposed on the sole 2. The upper 3 constitutes a region in contact with the foot of the wearer, and is made of a bag-shaped member that can be flexibly deformed. The upper 3 is made of a fiber sheet containing heat-shrinkable yarns. The upper 3 has a wearing opening 3*a*.

The shell 4 accommodates the sole 2 and the upper 3. The shell 4 constitutes an outermost shell of the shoe 1 and is made of a single flexible member formed in a bag shape. The shell 4 covers a bottom surface of the sole 2 and a surface of the upper 3.

Figure 4:
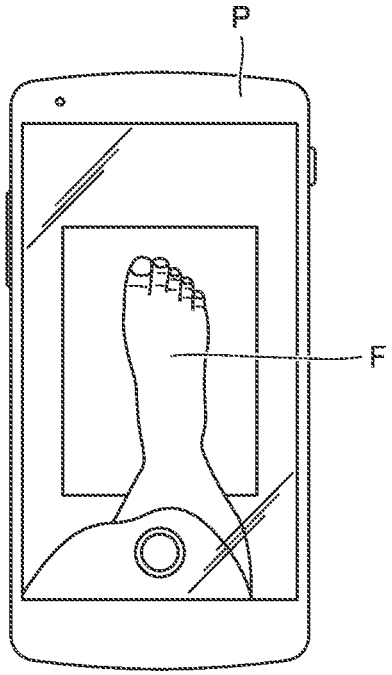
FIG. 4 is a view illustrating a state in which an image of a foot of a wearer is captured in order to obtain a foot form model.

FIG. 4 is a view illustrating a state in which an image of a foot F of the wearer is captured in order to obtain a foot form model FM. As illustrated in FIG. 4, the image of the foot F of the wearer is captured by a photographable portable terminal such as a smartphone P or a digital camera, and image data of the foot F is acquired. The image data of the foot F may be captured at a store visited by the wearer. The store may be a fixed store or a moving store using an automobile, a trailer, or the like. Alternatively, the image data of the foot F may be captured at a home of the wearer. The image data obtained by capturing the foot F by the wearer may be transmitted to a server of a shoe manufacturer.

Figure 5:
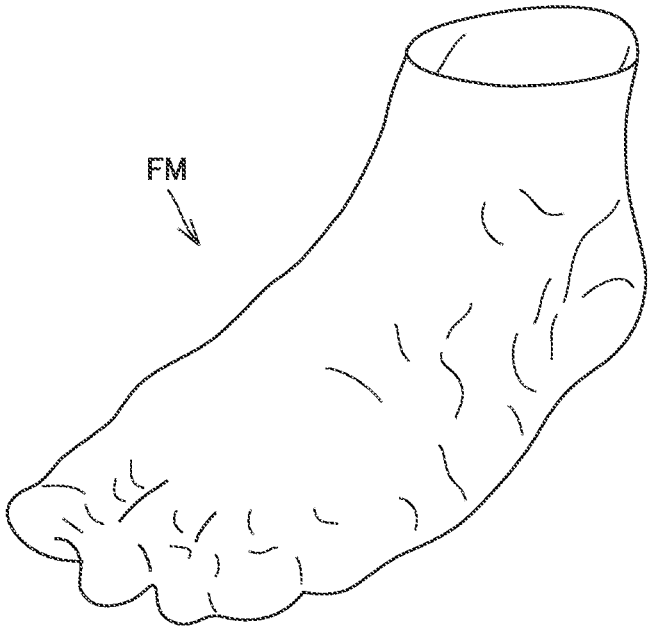
FIG. 5 is a perspective view of the foot form model.

FIG. 5 is a perspective view of the foot form model FM. The foot form model FM in FIG. 5 is a three-dimensional foot form model generated from the measurement data of each unit of the foot F of the wearer acquired from the image data of the foot F. For example, when an image of the foot F of the wearer is captured by a smartphone P, the foot form model FM can be generated based on the image data by software previously installed in the smartphone P. Alternatively, the foot form model FM may be generated by performing calculation using both the captured image data and the data in a server used by the shoe manufacturer.

The foot form model FM may be formed in the same shape as the shape of the foot F of the wearer. Alternatively, for design or functional reasons, a specific location of the foot form model FM may be corrected to the shape of the foot F of the wearer by a desired dimension.

Figure 6:
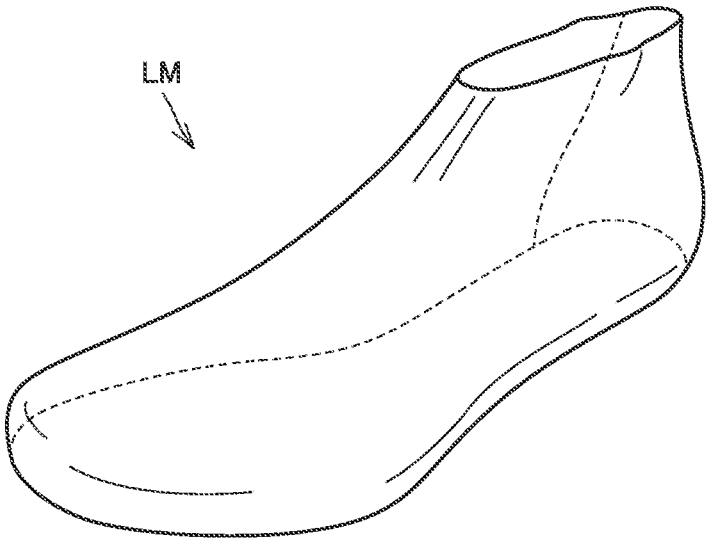
FIG. 6 is a perspective view illustrating a last model produced based on the foot form model.

FIG. 6 is a perspective view of a last model LM. The last model LM in FIG. 6 is a last model that is produced based on the foot form model FM in FIG. 5 and customized to the shape of the foot F of the wearer. The upper 3 is formed using a last 10 (see FIG. 7) produced according to the last model LM, so that the tailor-made shoe 1 dedicated to the wearer is manufactured.

Figure 7:
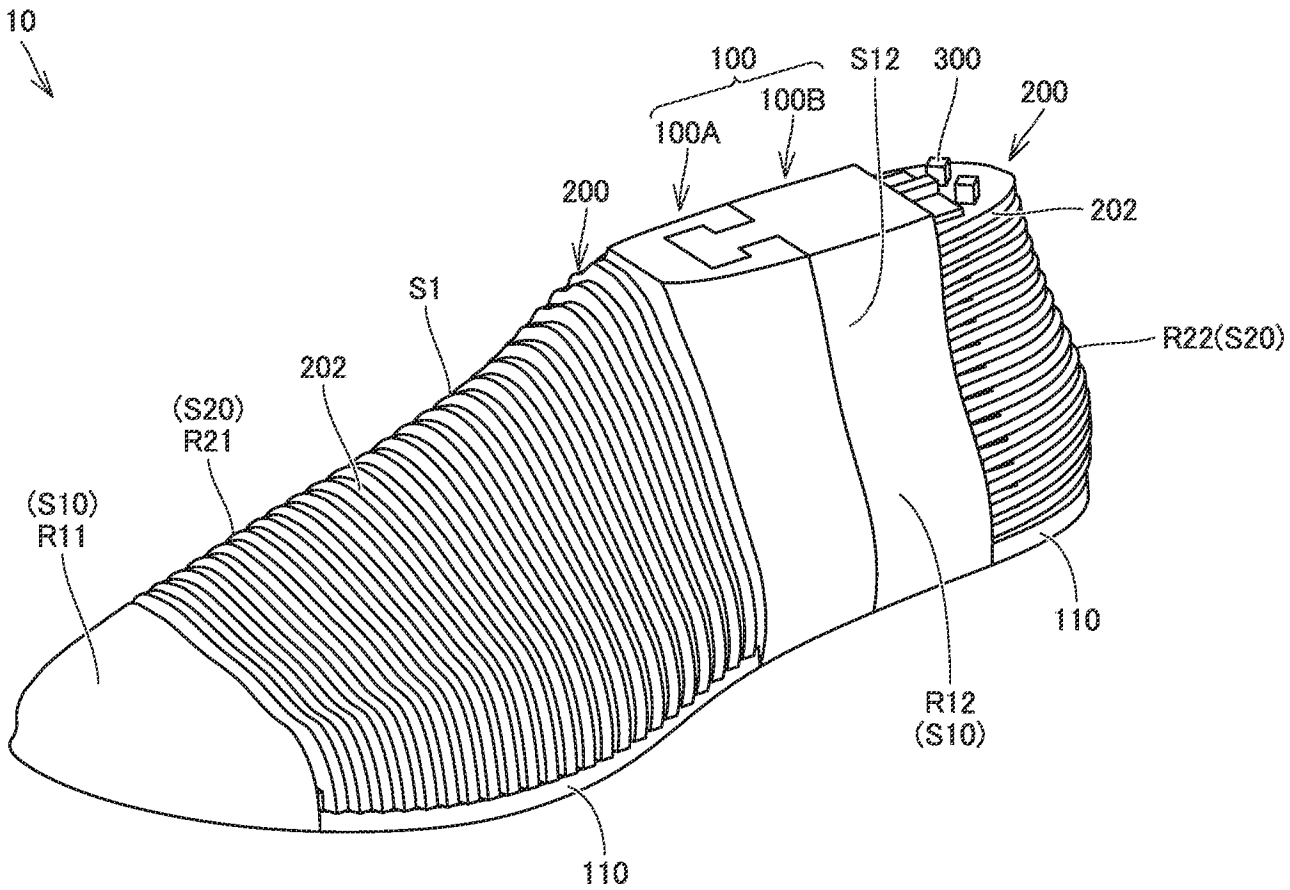
FIG. 7 is a perspective view illustrating a last according to an embodiment of the present disclosure produced based on the last model.

FIG. 7 is a perspective view illustrating the last of the embodiment of the present disclosure produced based on the last model. The last 10 has an upper forming surface S1 for forming the upper 3. The last 10 includes a base part 100, a plurality of additional parts 200, and a coupling member 300 (see FIGS. 12 to 14).

Figure 8:
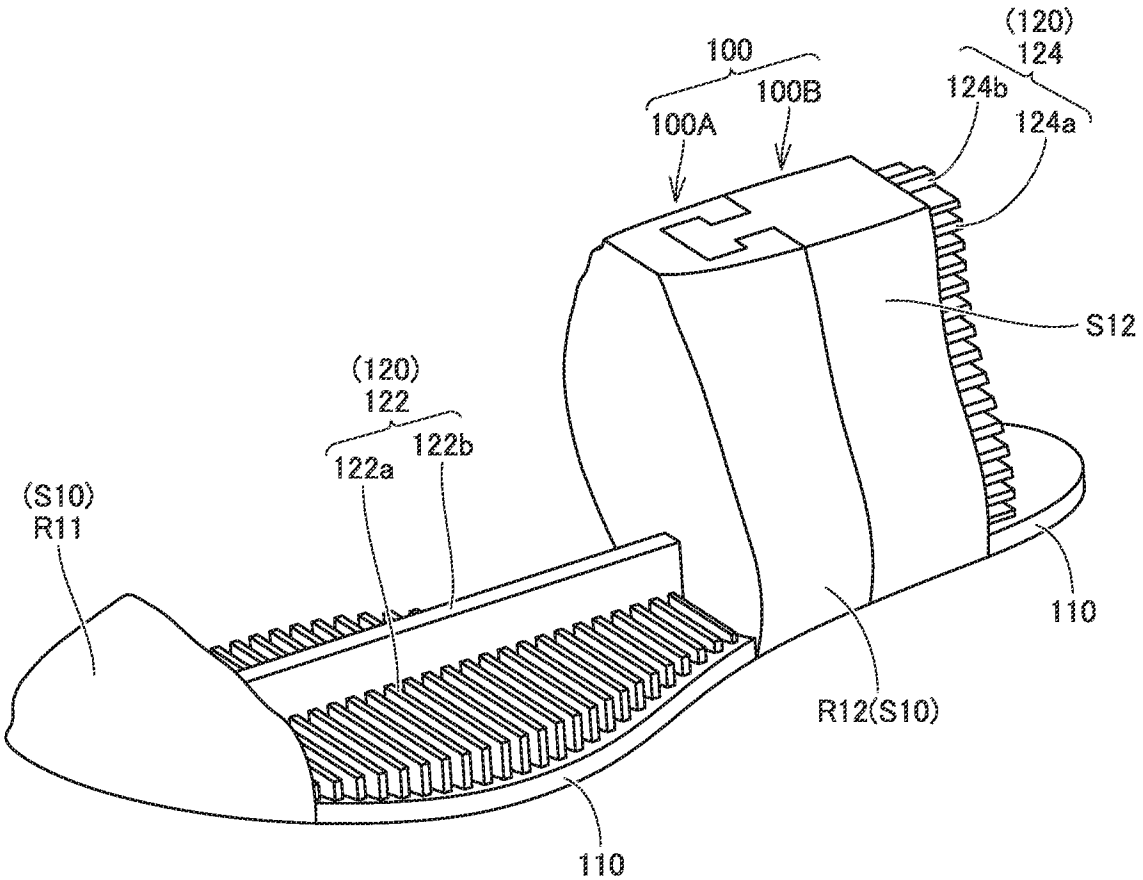
FIG. 8 is a perspective view of a base part of the last.

The base part 100 is made of resin, wooden material, metal, pulp solidified, or the like. As illustrated in FIG. 8, the base part 100 includes a bottom 110, a mounting unit 120, and a first forming surface S10.

The bottom 110 defines a bottom surface of the upper 3. The bottom 110 is formed in a flat plate shape. The bottom 110 has a shape extending from a rear end to a front end of the upper forming surface S1.

The first forming surface S10 defines a first region in the upper forming surface S1. The first region is a region in which a difference in the shape of the foot for each wearer is relatively small. In the embodiment, the first region includes a toe region R11 and an intermediate region R12.

The toe region R11 is a region forming a location covering the toe of the wearer in the upper 3. The toe region R11 is formed at the front end of the bottom 110.

The intermediate region R12 is a region forming a location covering the intermediate portion of the foot of the wearer in the foot length direction in the upper 3. The intermediate portion is a location overlapping with an ankle of the wearer in the height direction. That is, the intermediate region R12 is a location that forms the member below the wearing opening 3*a* in the upper 3. The intermediate region R12 includes a wearing opening forming unit S12 that forms the wearing opening 3*a*.

Figure 9:
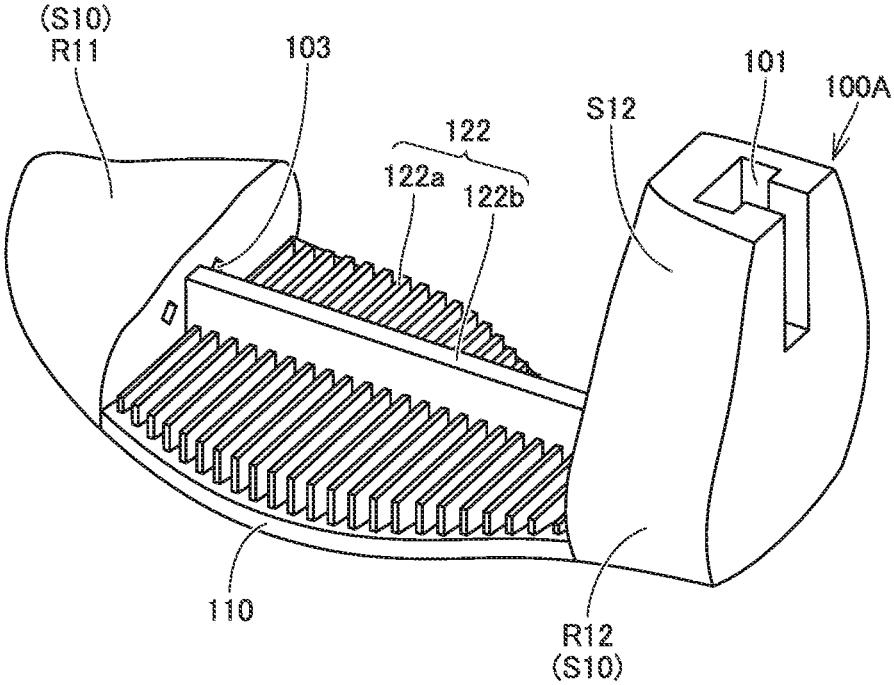
FIG. 9 is a perspective view of a first base member.
Figure 10:
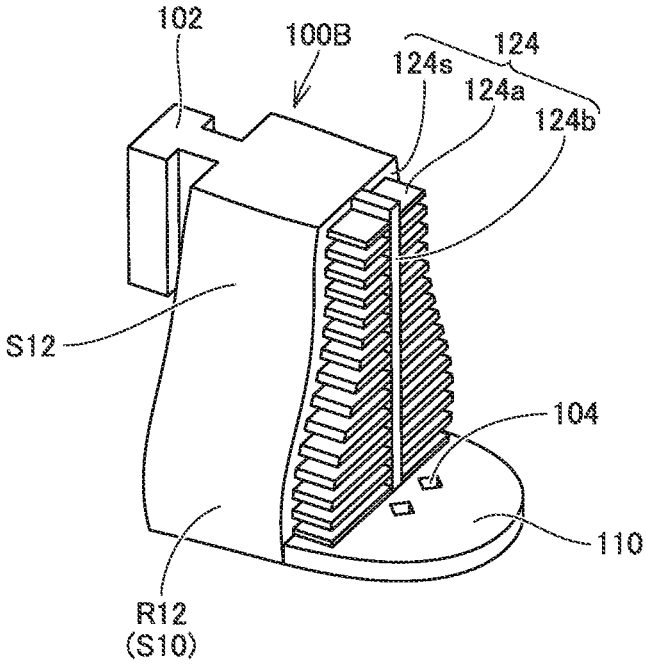
FIG. 10 is a perspective view of a second base member.

The mounting unit 120 is a location mounting the plurality of additional parts 200 such that the plurality of additional parts 200 are arranged in a multi-layered shape along one direction. As illustrated in FIGS. 8 to 10, the mounting unit 120 includes a front mounting unit 122 and a rear mounting unit 124.

The front mounting unit 122 is located in front of the wearing opening forming unit S12. The front mounting unit 122 is formed at a position corresponding to at least a forefoot portion of the wearer of the shoe 1. The front mounting unit 122 is formed between the toe region R11 and the intermediate region R12.

As illustrated in FIGS. 8 and 9, the front mounting unit 122 includes a plurality of partition plates 122*a* and a rail 122*b*.

Each partition plate 122*a* has a shape rising from the bottom 110 and extending in the foot width direction. The plurality of partition plates 122*a* are arranged side by side at intervals in the foot length direction. As illustrated in FIGS. 7 and 8, a distance between a pair of partition plates 122*a* adjacent to each other in the foot length direction among the plurality of partition plates 122*a* is set to a size with which each additional part 200 is capable of being disposed between the pair of partition plates 122*a*.

The rail 122*b* is connected to the plurality of partition plates 122*a*. The rail 122*b* has a shape extending in the foot length direction. The rail 122*b* has a shape rising from the bottom 110. The height of the rail 122*b* may be larger than the height of each partition plate 122*a*.

The rear mounting unit 124 is located behind the front mounting unit 122. The rear mounting unit 124 is formed behind the intermediate region R12 including the wearing opening forming unit S12. As illustrated in FIGS. 8 and 10, the rear mounting unit 124 includes a back face 124*s*, a plurality of partition plates 124*a*, and a rail 124*b*.

The back face 124*s* stands upright from the bottom 110. The back face 124*s* is formed flat. The back face 124*s* is orthogonal to the bottom 110.

Each partition plate 124*a* protrudes from the back face 124*s* in parallel with the bottom 110 and extends in the foot width direction. The plurality of partition plates 124*a* are arranged side by side at intervals in the height direction. As illustrated in FIGS. 7, 8, and 10, a distance between a pair of partition plates 124*a* adjacent to each other in the height direction among the plurality of partition plates 124*a* is set to a size with which each additional part 200 is capable of being disposed between the pair of partition plates 124*a*. As illustrated in FIG. 10, the plurality of partition plates 124*a* have a shape in which the length in the foot width direction gradually increases as approaching the bottom 110.

The rail 124*b* is connected to the plurality of partition plates 124*a*. The rail 124*b* has a shape extending in the height direction. The rail 124*b* has a shape protruding from the back face 124*s*. The length of the rail 124*b* in the foot length direction may be the same as the length of each partition plate 124*a* in the same direction.

Figure 15:
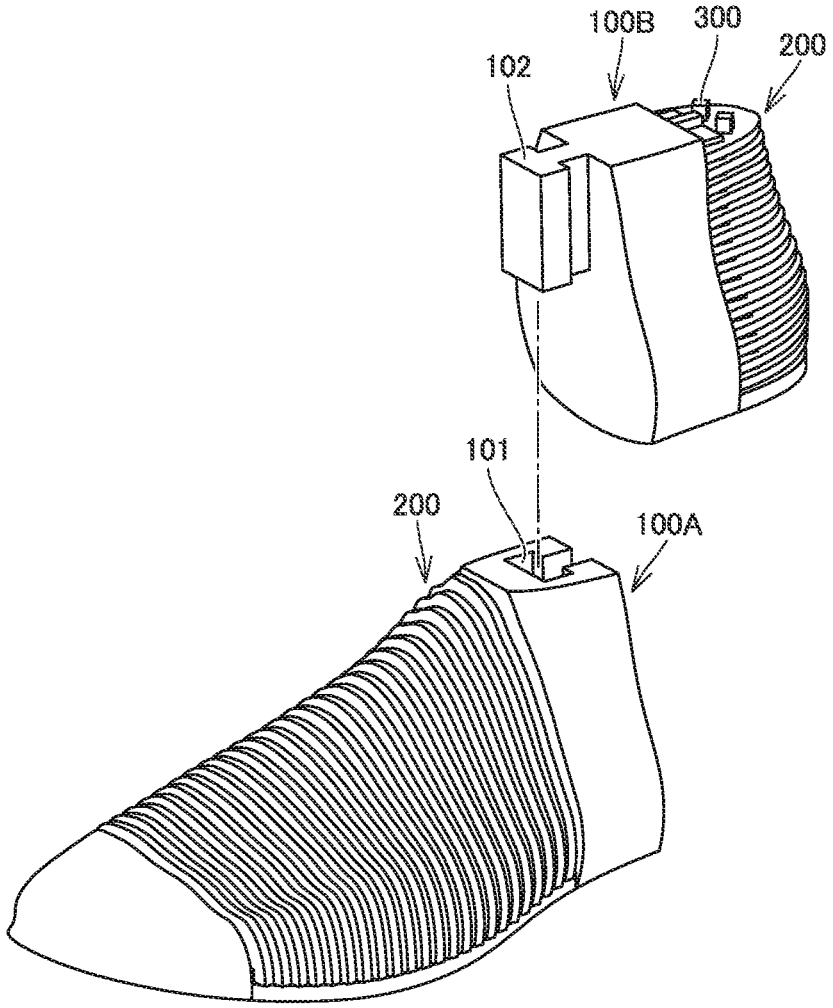
FIG. 15 is a perspective view illustrating a state in which the first base member and the second base member are separated from each other.

As illustrated in FIGS. 7 to 10 and 15, the base part 100 includes a first base member 100A and a second base member 100B. The second base member 100B is attachable to and detachable from the first base member 100A. As illustrated in FIG. 15, the second base member 100B can be vertically divided with respect to the first base member 100A.

A boundary portion between the first base member 100A and the second base member 100B is formed in the intermediate region R12, namely, at a position passing through the wearing opening forming unit S12 in the height direction. The boundary portion extends in the height direction. The front mounting unit 122 is located in front of the boundary, and the rear mounting unit 124 is located behind the boundary. That is, the first base member 100A includes the front mounting unit 122, the toe region R11, and the front portion of the intermediate region R12, and the second base member 100B includes the rear mounting unit 124 and the rear portion of the intermediate region R12.

As illustrated in FIGS. 9 and 15, a first engagement unit 101 is formed at a rear end of the first base member 100A, and a second engagement unit 102 that is engaged with the first engagement unit 101 is formed at a front end of the second base member 100B. In the embodiment, the first engagement unit 101 is formed of a recessed extending in the height direction, and the second engagement unit 102 is formed of a protrusion extending in the height direction and having a shape corresponding to the first engagement unit 101. However, the first engagement unit 101 may be formed in the protrusion, and the second engagement unit 102 may be formed in the recess.

Figure 11:
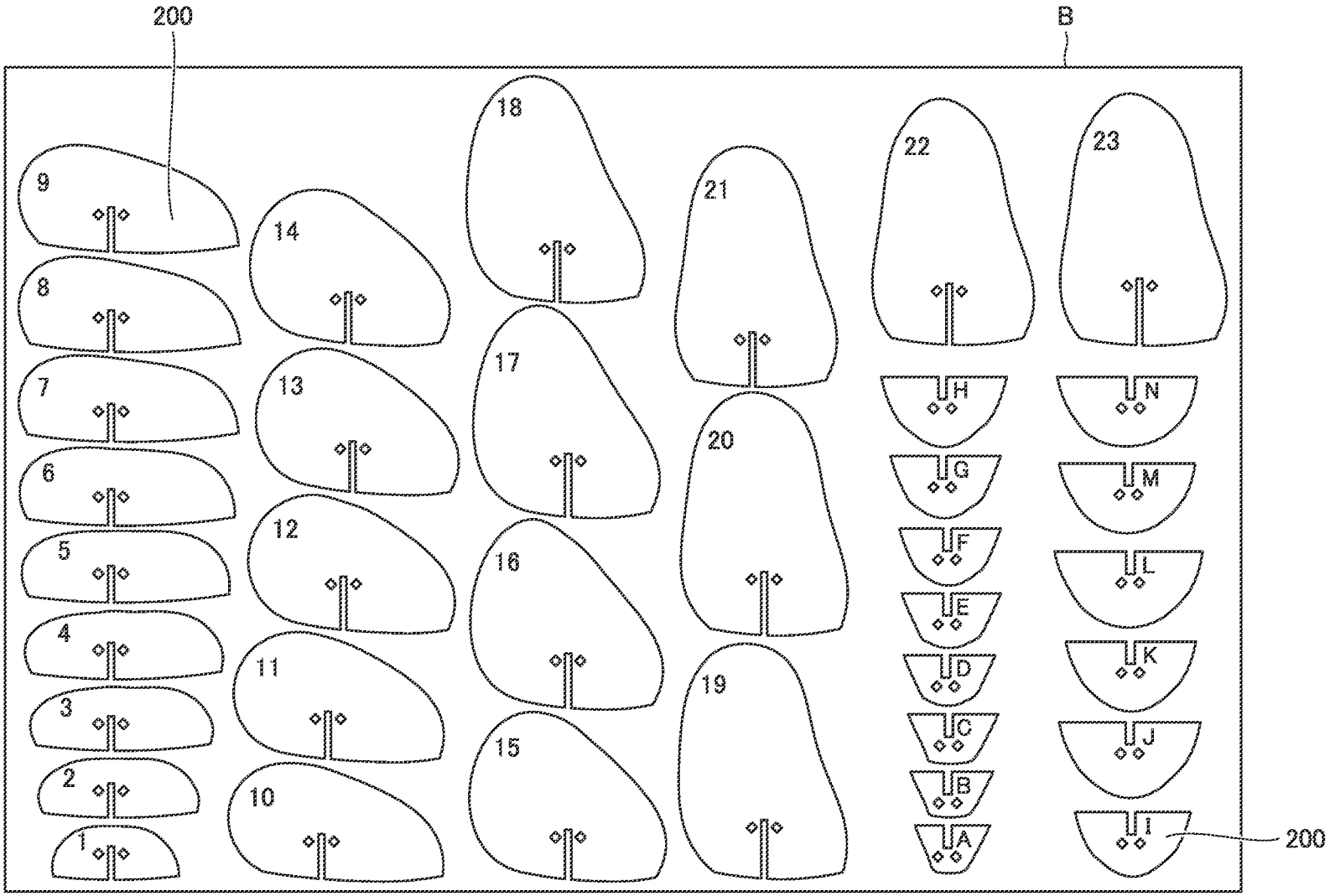
FIG. 11 is a view schematically illustrating a pattern in which a plurality of additional parts are disposed on a board.

FIG. 11 is a view schematically illustrating a pattern in which the plurality of additional parts are disposed on the board. The plurality of additional parts 200 are cut out from a board B in FIG. 11. Among the plurality of additional parts 200 formed on the board B, the additional part 200 denoted by a number is the additional part 200 that is mounted on the front mounting unit 122, and the additional part 200 denoted by an alphabet is an additional part 200 that is mounted on the rear mounting unit 124. The pattern formed on the board B is set based on the last model LM.

For example, the board B is made of a medium-density fiber board (MDF). The board B is not limited to the MDF, but may be constituted by another wooden board such as an insulation fiberboard (IB) or a hard fiberboard (HB). A class-A insulation board, a tatami board, or a sealing board can be cited as an example of the IB. A standard board and a tempered board can be cited as examples of the HB. Alternatively, the board B may be formed of a material, such as cardboard with high recyclability, cork, metal, or thermoplastic resin, which is suitable for the additional part 200.

The plurality of additional parts 200 can be mounted on the mounting unit 120 of the base part 100. Each additional part 200 is formed in a plate shape. The plurality of additional parts 200 include a second forming surface S20 that defines a second region different from the first region in the upper forming surface S1 in the state of being mounted to the mounting unit 120 (the state illustrated in FIG. 7). The second region is a region where the difference in the shape of the foot for each wearer is relatively large. In the embodiment, the second region includes a front region R21 corresponding to an instep of the foot of the wearer and a rear region R22 corresponding to the heel of the foot of the wearer.

Each additional part 200 has an end face 202. The second forming surface S20 is constituted of the end face 202 of each of the plurality of additional parts 200. The front region R21 is constituted of the end face 202 of each of the plurality of additional parts 200 mounted on the front mounting unit 122, and the rear region R22 is constituted of the end face 202 of each of the plurality of additional parts 200 mounted on the rear mounting unit 124.

Figure 12:
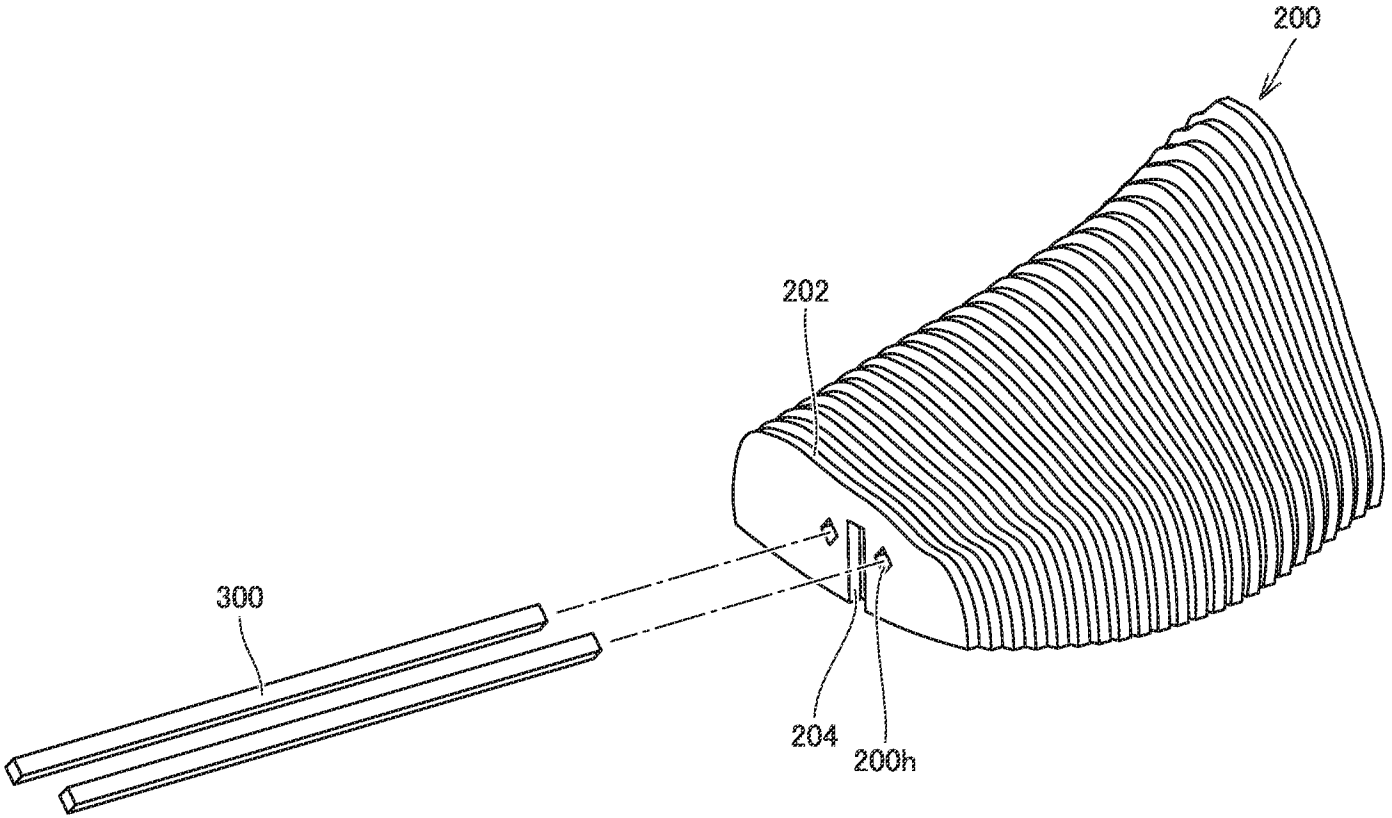
FIG. 12 is a perspective view illustrating a plurality of additional parts and a coupling member that are attached to a front mounting unit and a coupling member.
Figure 13:
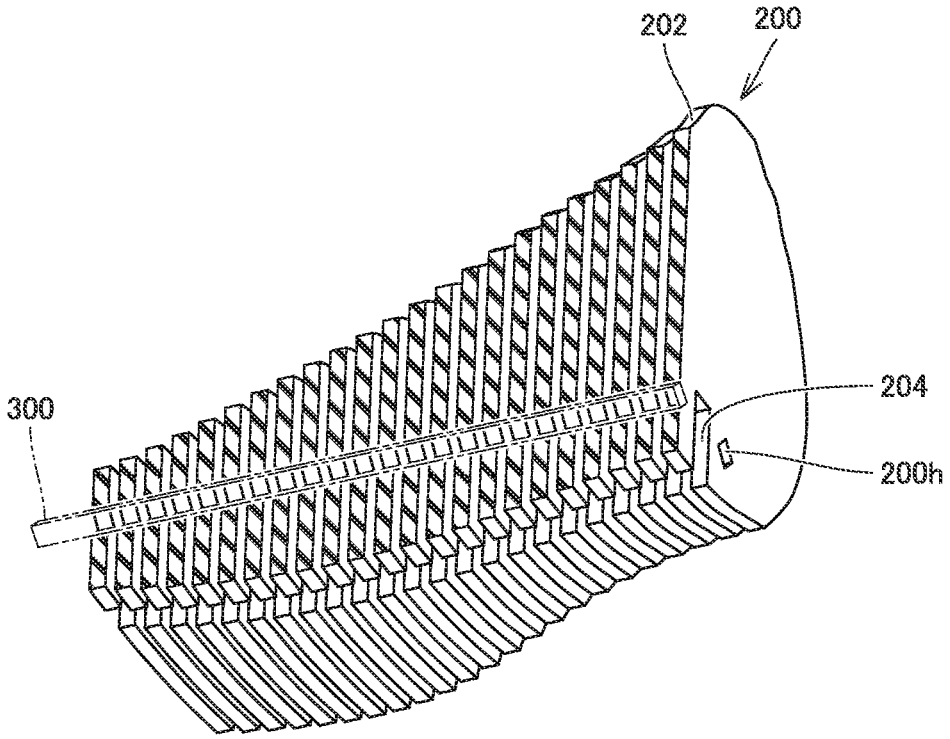
FIG. 13 is a sectional perspective view illustrating the plurality of additional parts and the coupling member in FIG. 12.
Figure 14:
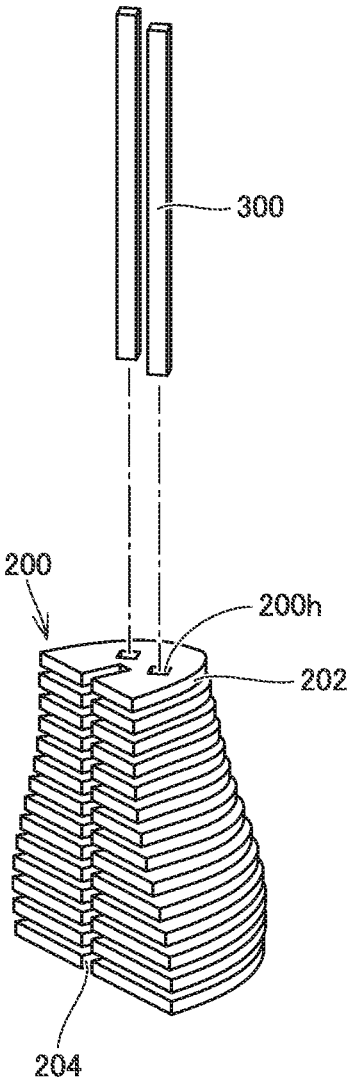
FIG. 14 is a perspective view illustrating the plurality of additional parts and the coupling member that are attached to a rear mounting unit.

As illustrated in FIGS. 12 to 14, an insertion hole 200*h* and a groove 204 are formed in each additional part 200.

The insertion hole 200*h* is a through-hole through which the coupling member 300 is inserted. As illustrated in FIGS. 12 and 13, the coupling member 300 is inserted into the insertion holes 200*h* of the plurality of additional parts 200 to couple the plurality of additional parts 200. The coupling member 300 is formed in a linearly extending shape (rod shape). The coupling member 300 inserted through each additional part 200 mounted on the front mounting unit 122 is inserted into a recess 103 (see FIG. 9) formed in the toe region R11. The coupling member 300 inserted into each additional part 200 mounted on the rear mounting unit 124 is inserted into a recess 104 (see FIG. 10) formed in the bottom 110.

The groove 204 has a shape capable of receiving the rails 122*b*, 124*b*. The groove 204 is formed on an end face of the outer peripheral surface of the additional part 200 opposite to the end face 202 constituting the second forming surface S20.

The last 10 described above is covered with an upper forming material (upper before forming) made of a fiber sheet containing heat-shrinkable yarns, and the upper forming material is heat-treated. Then, the heat-shrinkable yarn contained in the upper forming material shrinks, so that the upper 3 is formed along the upper forming surface S1 of the last 10.

Thereafter, by moving the second base member 100B upward with respect to the first base member 100A, the second base member 100B and the plurality of additional parts 200 attached thereto are taken out from the wearing opening 3*a* of the upper 3 while the second base member 100B is separated from the first base member 100A. Subsequently, the first base member 100A and the plurality of additional parts 200 attached thereto are taken out from the wearing opening 3*a*.

As described above, in the last 10 of the embodiment, the optional second forming surface S20 can be easily formed by selecting the additional part 200 that is mounted on the mounting unit 120 in the base part 100. Furthermore, because the base part 100 includes the first base member 100A and the second base member 100B, the second base member 100B is separated from the first base member 100A after the upper 3 is formed by the last 10, so that the last 10 can be easily taken out from the wearing opening 3*a* of the upper 3.

Hereinafter, modifications of the embodiment will be described.

(First Modification)

Figure 16:
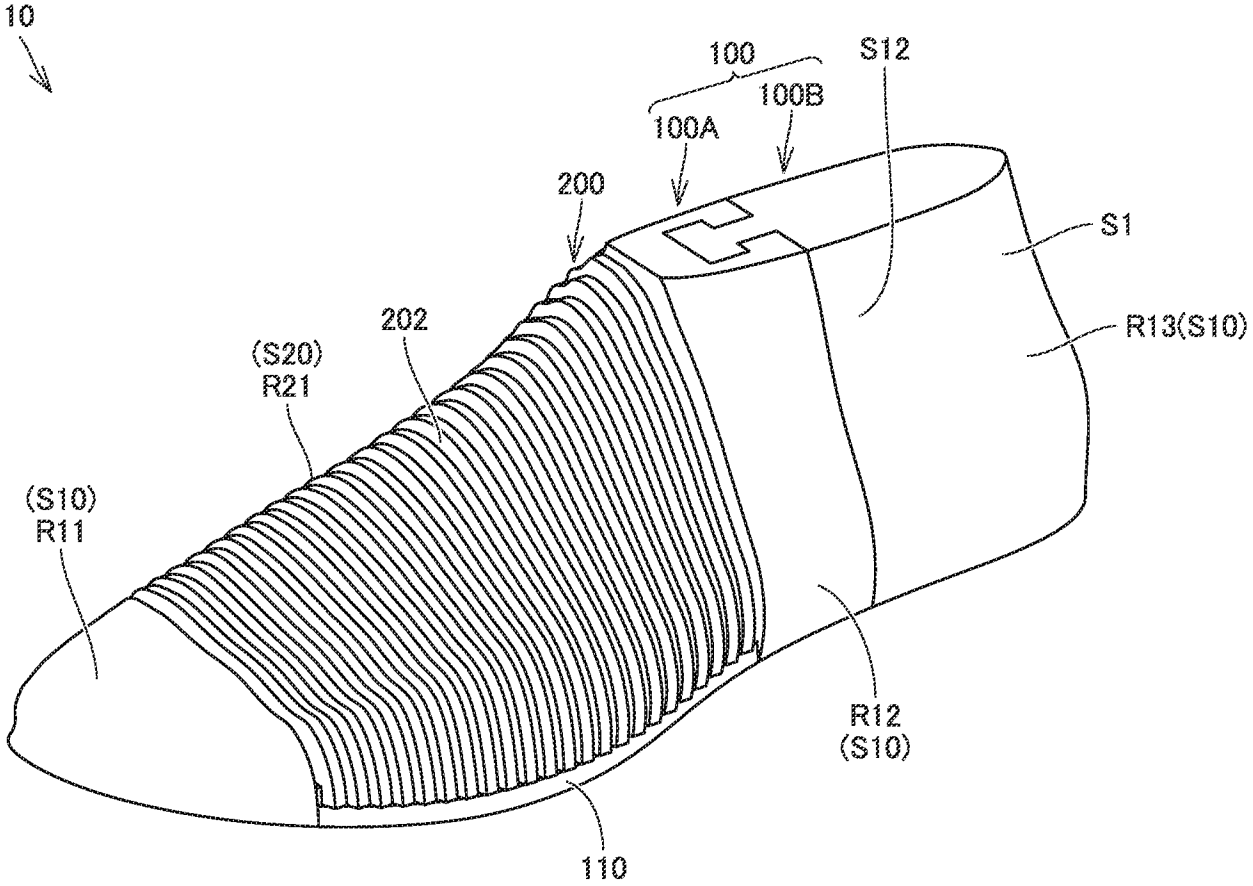
FIG. 16 is a perspective view illustrating a modification of the last.

As illustrated in FIG. 16, the mounting unit 120 may be formed only of the front mounting unit 122 of the first base member 100A, but the second base member 100B may not include the rear mounting unit. In this case, the surface of the second base member 100B constitutes a part of the first forming surface S10. In this example, the first region further includes a posterior region R13 that defines a plane along the heel. In this example, the second base member 100B may be constituted of being dividable in the foot length direction.

(Second Modification)

Figure 17:
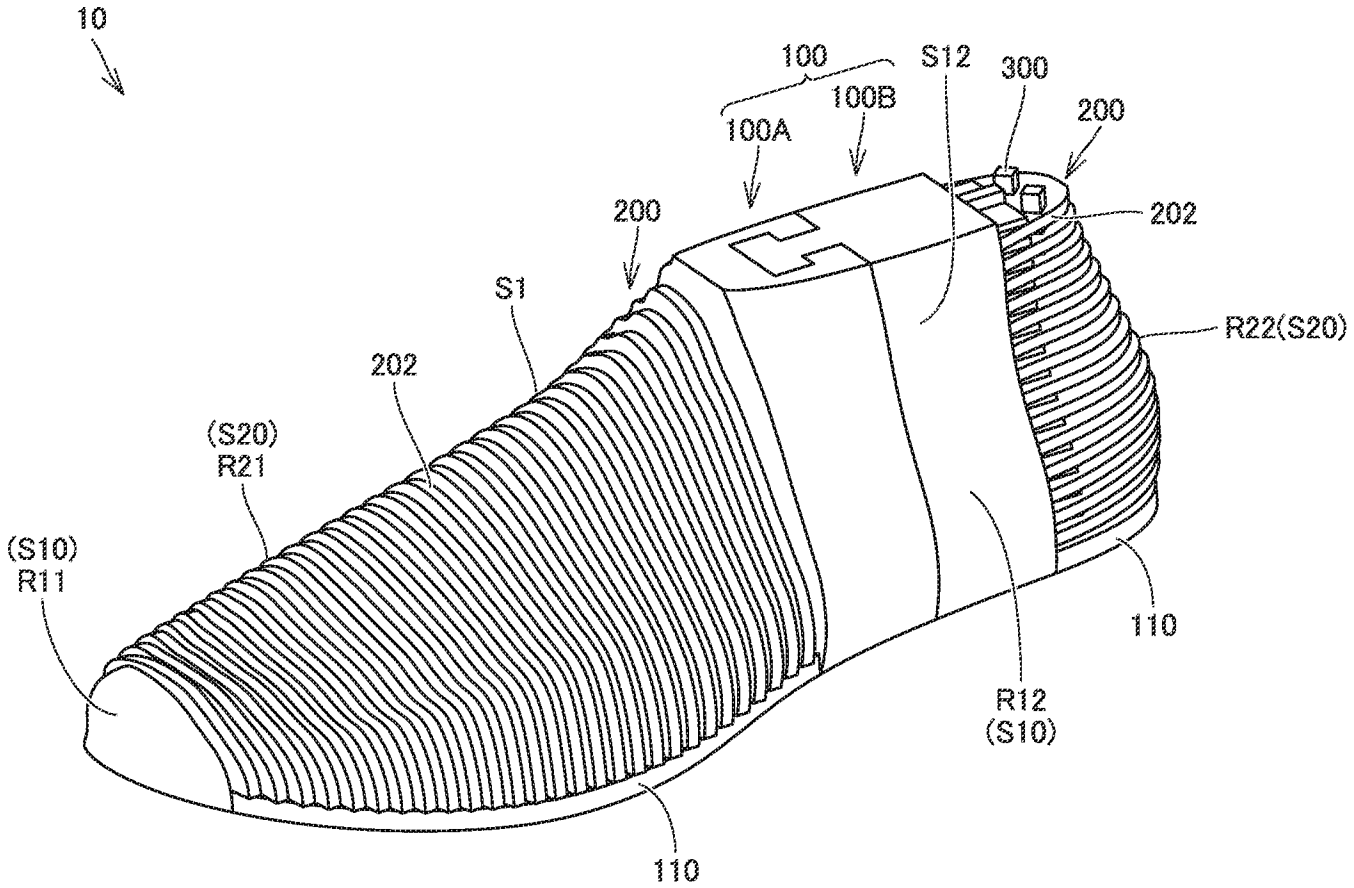
FIG. 17 is a perspective view illustrating a modification of the last.

As illustrated in FIG. 17, the toe region R11 may be formed to be smaller than that of the embodiment. In this example, the front mounting unit 122 is extended forward in the foot length direction.

(Third Modification)

Figure 18:
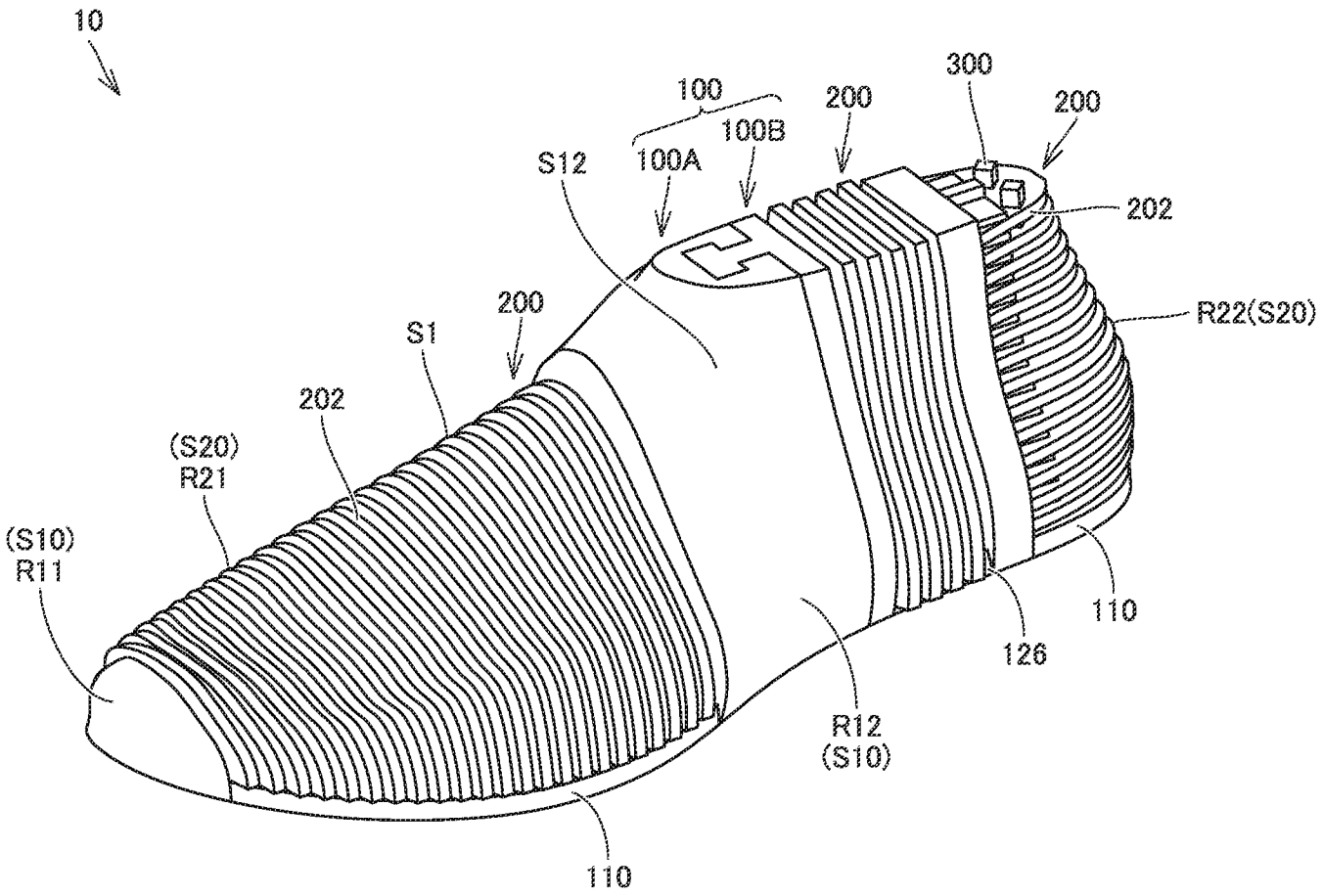
FIG. 18 is a perspective view illustrating a modification of the last.

As illustrated in FIG. 18, the second base member 100B may further include an intermediate mounting unit 126 located between the front mounting unit 122 and the rear mounting unit 124. In this example, the end face 202 of each additional part 200 mounted on the intermediate mounting unit 126 also constitutes a part of the second forming surface S20.

(Fourth Modification)

Figure 19:
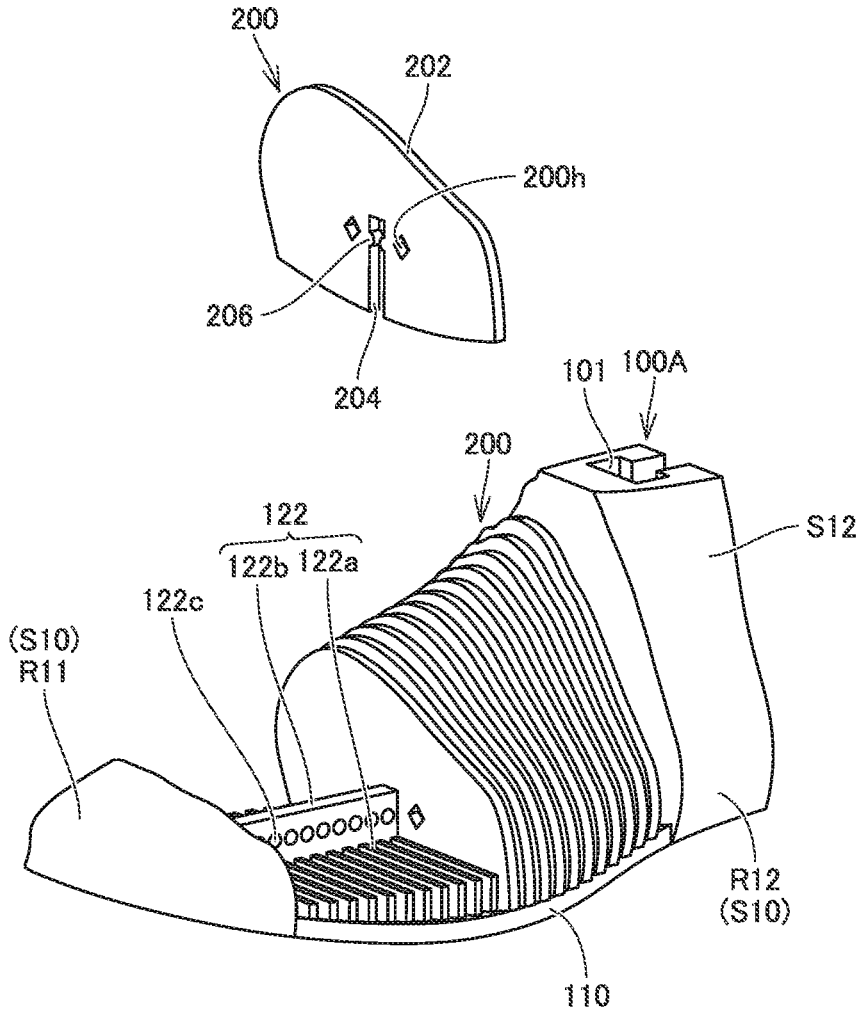
FIG. 19 is a perspective view illustrating a modification of the front attachment and the additional part attached to the front mounting unit.

As illustrated in FIG. 19, a plurality of locking units 122*c* arranged side by side in the foot length direction may be provided the rail 122*b*, and a pair of protrusions 206 that is engaged with the locking unit 122*c* may be provided in each additional part 200. In the example of FIG. 19, each locking unit 122*c* is constituted of a through-hole penetrating the rail 122*b* in the foot width direction. The pair of protrusions 206 has a shape protruding in a direction approaching each other from the inner side surface of the groove 204. In this aspect, upward separation of each additional part 200 from the front mounting unit 122 is prevented.

The above is also applicable to the rear mounting unit 124 and the additional part 200 attached thereto.

(Fifth Modification)

Figure 20:
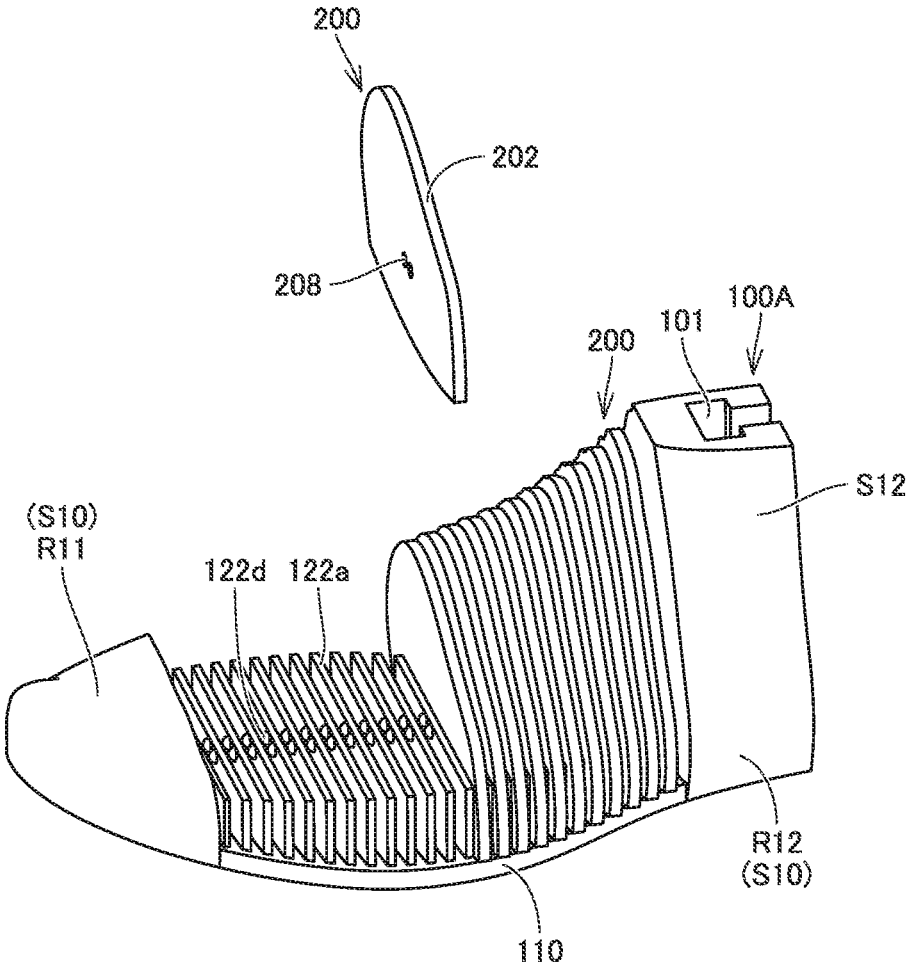
FIG. 20 is a perspective view illustrating a modification of the front attachment and the additional part attached to the front mounting unit.

As illustrated in FIG. 20, a protrusion 122*d* protruding in the foot length direction may be provided in each partition plate 122*a*, and an engaging unit 208 that is engaged with the protrusion 122*d* may be provided in each additional part 200. In the example of FIG. 20, the engaging unit 208 is constituted of a through-hole penetrating the additional part 200 in its thickness direction.

In this aspect, the position of each additional part 200 with respect to first base member 100A in the foot width direction is effectively determined, and the upward separation of each additional part 200 from front mounting unit 122 is prevented.

The above is also applicable to the rear mounting unit 124 and the additional part 200 attached thereto.

(Sixth Modification)

Figure 21:
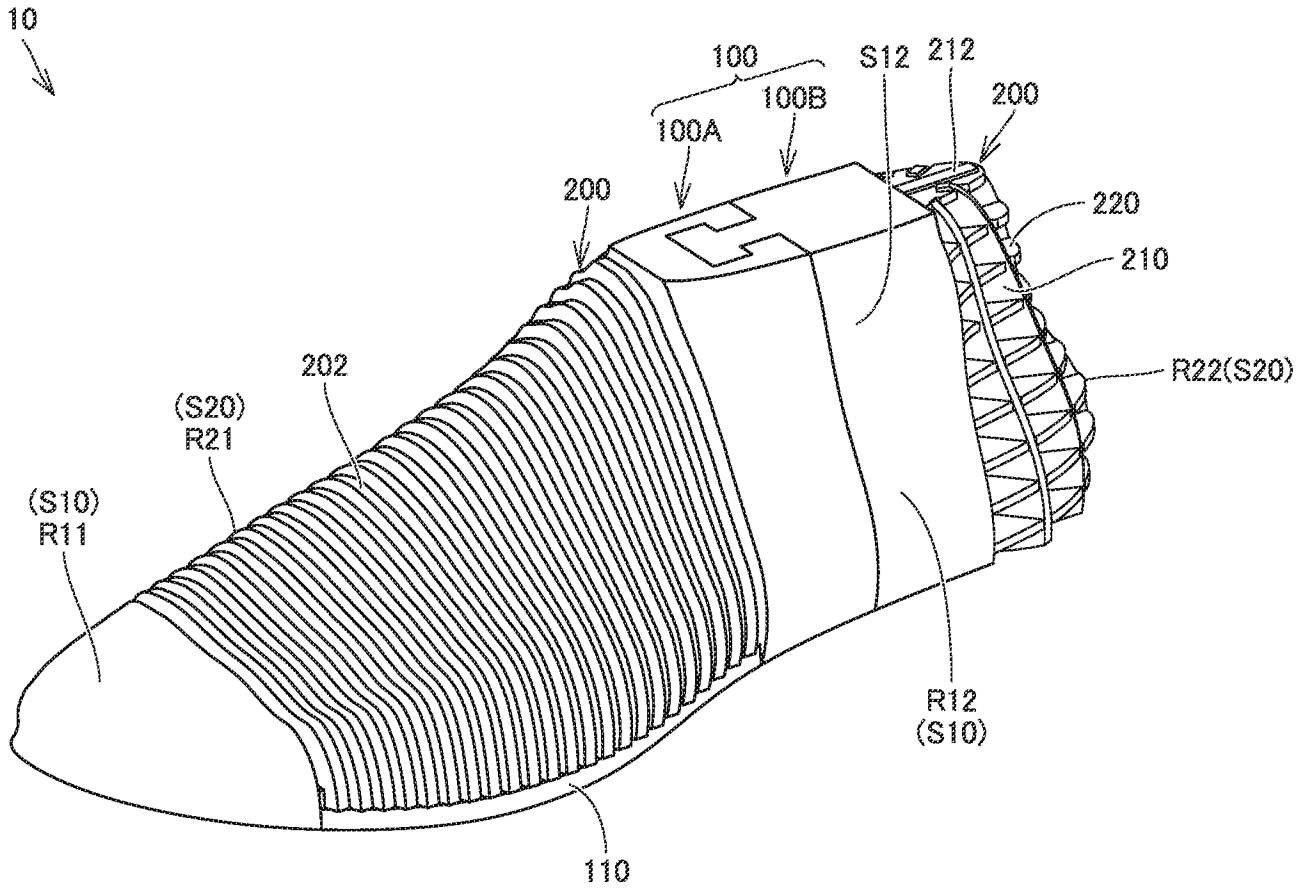
FIG. 21 is a perspective view illustrating a modification of the last.

As illustrated in FIG. 21, the bottom 110 may be omitted from second base member 100B, and a plurality of vertical parts 210 and a plurality of horizontal parts 220 may be included as the plurality of additional parts 200.

The plurality of vertical parts 210 include a central part 212 having a shape extending rearward from the rear surface of the second base member 100B. The central part 212 is connected to the back face of the second base member 100B. A plurality of grooves arranged at intervals in the height direction are formed in the central part 212, and each groove has a shape directed forward from the rear end of the central part 212.

Each horizontal part 220 is positioned relative to the central part 212 by being inserted into the groove of the central part 212. A groove extending radially is provided in each horizontal part 220.

Among the plurality of vertical parts 210, a part other than the central part 212 is inserted into the groove of each horizontal parts 220. Therefore, the plurality of vertical parts 210 is arranged so as to be substantially radial in planar view.

In this example, the rear region R22 is constituted of the end faces the plurality of vertical parts 210 and the end faces of the plurality of horizontal parts 220.

(Seventh Modification)

Figure 22:
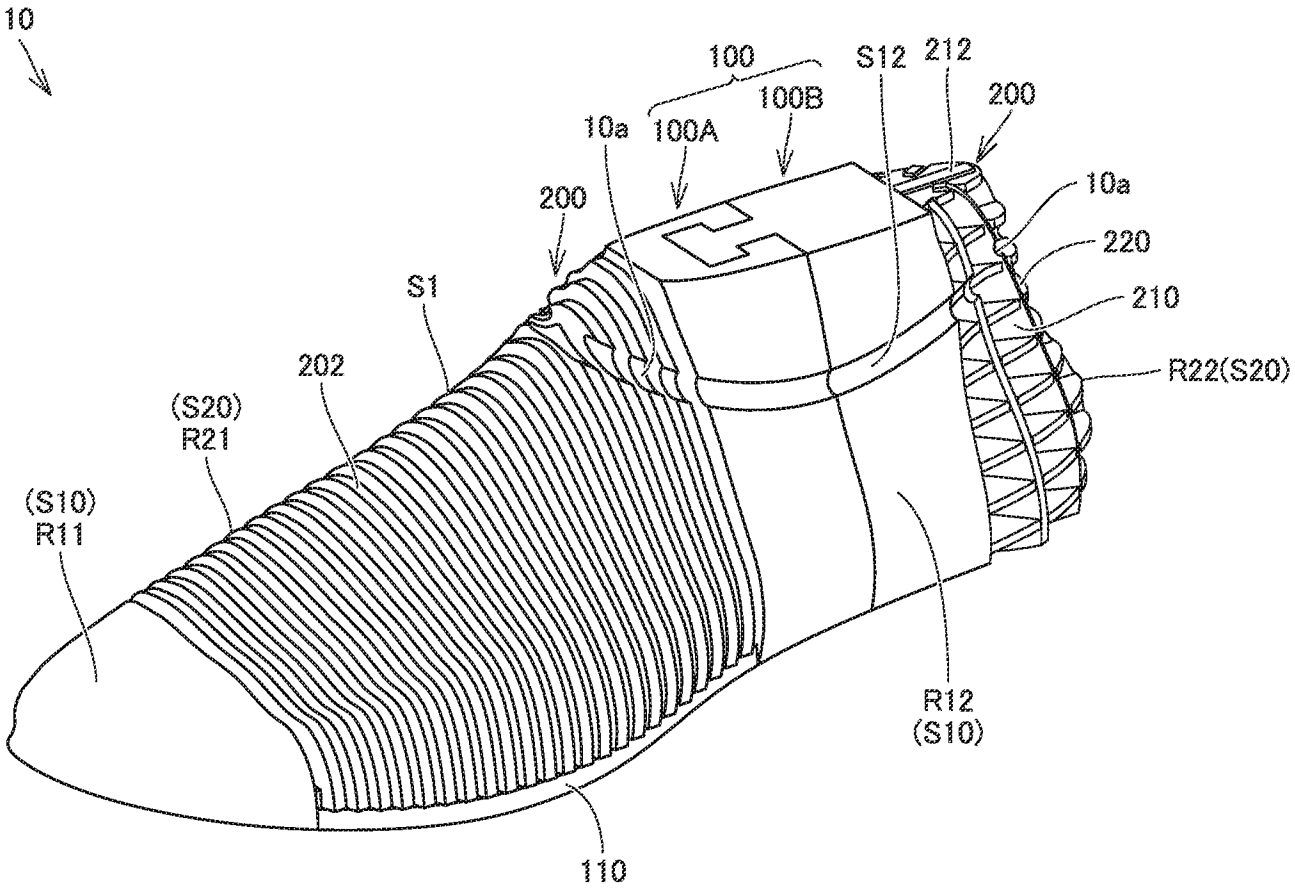
FIG. 22 is a perspective view illustrating a modification of the last.

As illustrated in FIG. 22, a notch 10*a* hooking the upper end (a location that becomes the wearing opening 3*a*) of the upper forming material may be provided in the last 10. In this example, the notch 10*a* is provided in the last 10 of FIG. 21. However, the notch 10*a* may be provided in the last 10 in the above-described embodiment and each modification.

(Eighth Modification)

In the above embodiment, the example in which each additional part 200 is produced based on the image data of the foot F of the wearer is illustrated. However, a large number of additional parts 200 having various outer shapes may be previously prepared, and a shape close to the shape of the foot F of the wearer may be appropriately selected from among them.

(Ninth Modification)

The last 10 described in the above embodiment may be used as a shoe keeper. In this case, the upper forming surface S1 of the last 10 functions as an upper holding surface that holds the shape of the upper 3 in the shoe 1. That is, the last 10 described in the above embodiment functions as a foot form member that can be used as both the last and the shoe keeper.

The configuration when the foot form member is used as the shoe keeper is as follows. That is, the shoe keeper includes a base part including the bottom and a plurality of additional parts each of which is formed in a plate shape and is capable of being assembled to the base part. The base part includes a mounting unit mounting the plurality of additional parts such that the plurality of additional parts are arranged in a multi-layered shape along one direction and a first holding surface that defines a first region of the upper holding surface. The plurality of additional parts have a second holding surface that defines a second region different from the first region in the upper holding surface in the state of being mounted on the mounting unit. Each of the plurality of additional parts has the end face. The second forming surface is constituted of the end surface of each of the plurality of additional parts. The base part includes a first base member including the mounting unit, and a second base member attachable to and detachable from the first base member.

(Tenth Modification)

Figure 23:
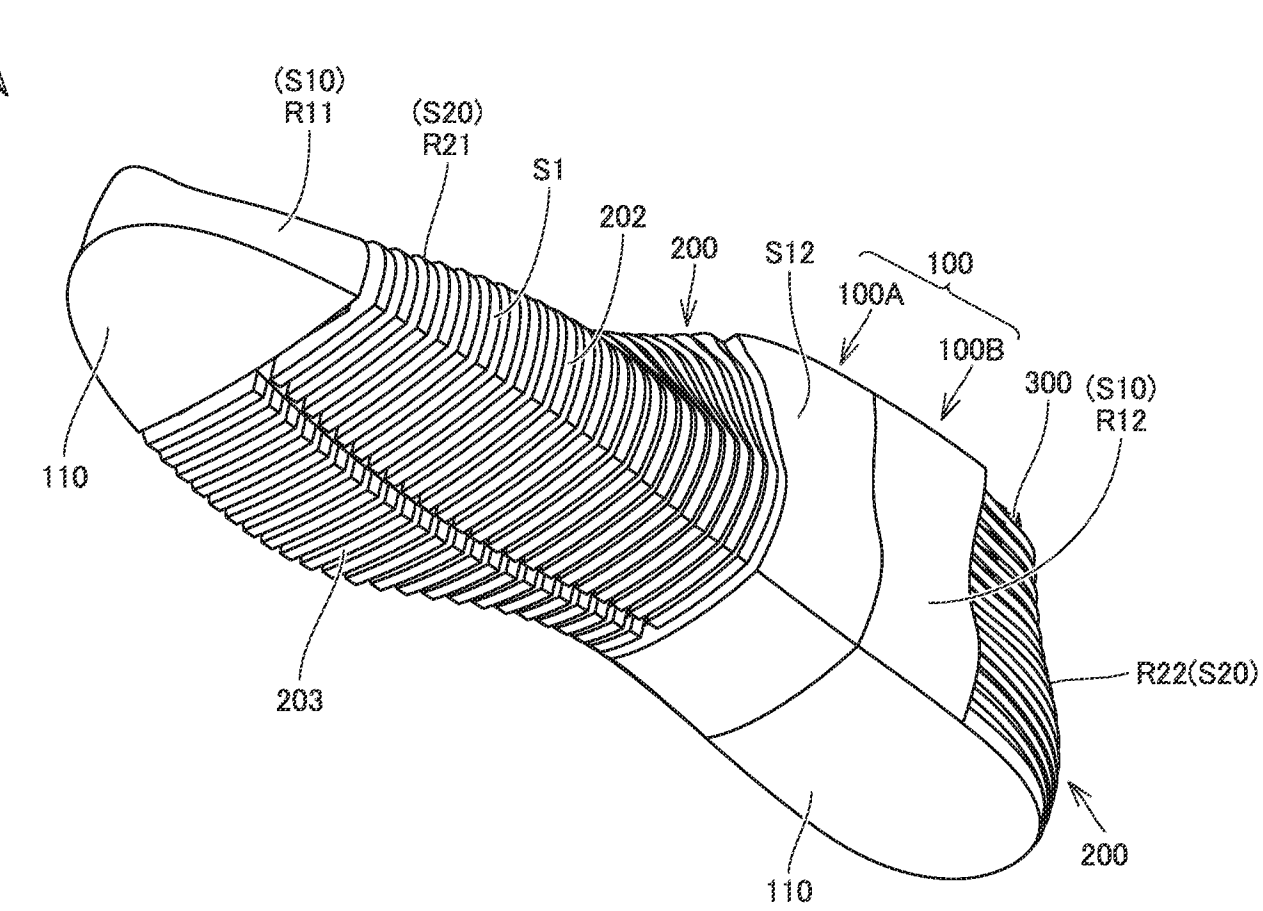
FIG. 23 is a perspective view illustrating a modification of the last.
Figure 24:
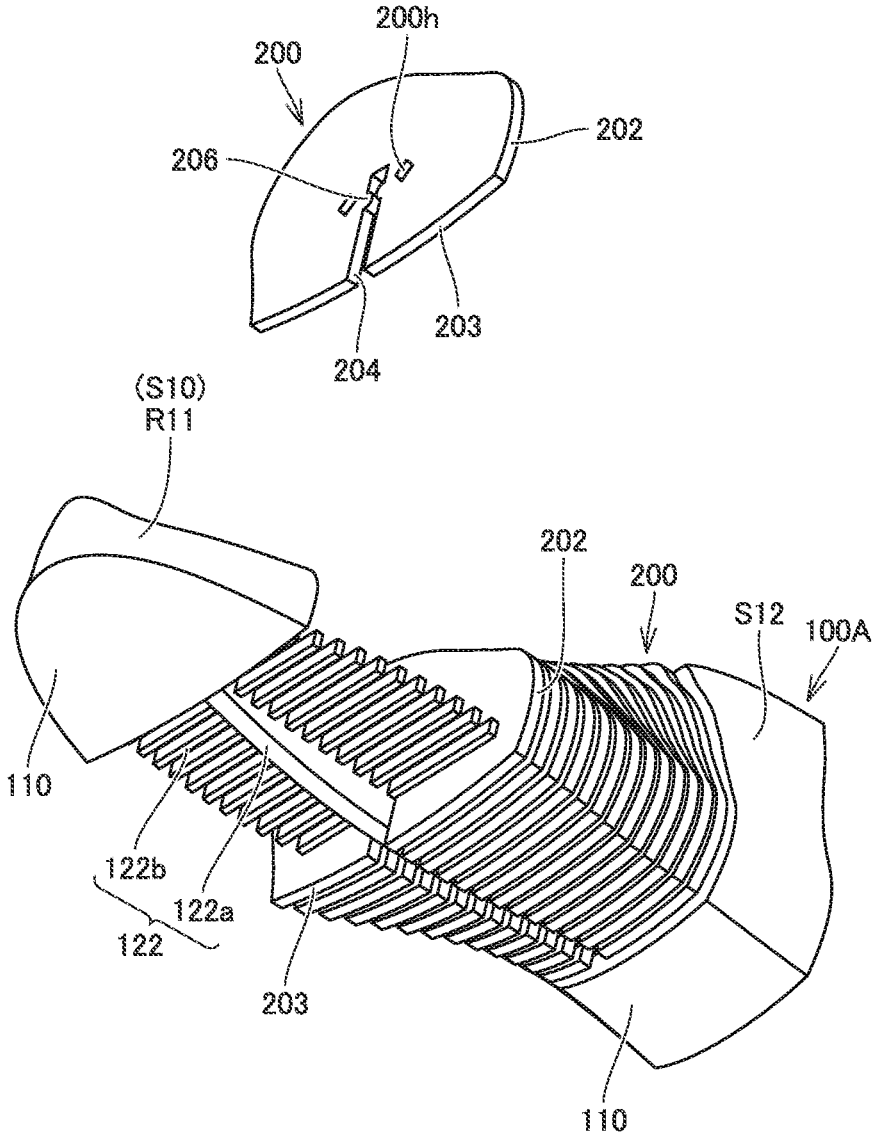
FIG. 24 is a perspective view illustrating a modification of the last.

As illustrated in FIGS. 23 and 24, a location of the bottom 110 located below the front mounting unit 122 may be omitted from the first base member 100A. In this case, each additional part 200 to be attached to front mounting unit 122 has a bottom end face 203. The bottom end face 203 of each of the plurality of additional parts 200 attached to front mounting unit 122 defines the bottom surface of the upper 3 together with the bottom 110 of the base part 100.

It is understood by those skilled in the art that the plurality of embodiments described above are specific examples of the following aspects.

A last according to one aspect of the present disclosure is a last including an upper forming surface for forming an upper including a wearing opening, the last including: a base part that includes a bottom defining a bottom surface of the upper; and a plurality of additional parts each of which is formed in a plate shape and is capable of being assembled to the base part, in which the base part includes: a mounting unit that mounts the plurality of additional parts such that the plurality of additional parts are arranged in a multi-layered form along one direction; and a first forming surface that defines a first region of the upper forming surface, the plurality of additional parts include a second forming surface defining a second region different from the first region in the upper forming surface while being attached to the mounting unit, each additional part in the plurality of additional parts has an end face, the second forming surface includes the end face of each of the plurality of additional parts, and the base part includes: a first base member that includes the mounting unit; and a second base member attachable to and detachable from the first base member.

In the last, an arbitrary second forming surface can be easily formed by selecting the additional part that is attached to the mounting unit in the base part. Furthermore, because the base part includes the first base member and the second base member, the second base member is separated from the first base member after the upper is formed by the last, so that the last can be easily taken out from the wearing opening of the upper.

The first forming surface may include a wearing opening forming unit that forms the wearing opening, the mounting unit may include a front mounting unit located in front of the wearing opening forming unit, and the first base member may include the front mounting unit. In this case, a boundary portion between the first base member and the second base member is preferably formed at a position corresponding to the wearing opening in a height direction.

In this aspect, after the upper is formed, the first base member and the second base member can be separated in a projection plane of the wearing opening, so that the last can be more easily taken out from the wearing opening of the upper.

In this case, the front mounting unit may include a plurality of partition plates each of which has a shape rising from the bottom and extending in a foot width direction, and the plurality of partition plates being arranged side by side at intervals in a foot length direction. A distance between a pair of partition plates adjacent to each other in the foot length direction among the plurality of partition plates is set to such a size that each of the additional parts is capable of being disposed between the pair of partition plates.

In this aspect, the position of each additional part with respect to the first base member in the foot length direction is effectively determined by disposing the additional part between the pair of partition plates.

The front mounting unit may further include a rail that is connected to the plurality of partition plates and has a shape extending in the foot length direction. A groove having a shape capable of receiving the rail is formed in each of the additional parts.

In this aspect, the position of each additional part with respect to the first base member in the foot width direction is effectively determined by inserting the rail into the groove.

Each of the additional parts to be attached to the front mounting unit may include a bottom end face. The bottom end face of each of the plurality of additional parts attached to the front mounting unit defines a bottom surface of the upper together with the bottom of the base part.

In this aspect, a location of the first base member located below the front mounting unit is not required to be formed, so that a freedom degree of the shape of the bottom surface of the upper increases.

The mounting unit may further include a rear mounting unit located behind the boundary portion between the first base member and the second base member. In this case, the second base member preferably includes the rear mounting unit.

In this aspect, the rear of the upper can also be formed on any forming surface.

Although the embodiment of the present invention has been described, it should be considered that the disclosed embodiment is an example in all respects and not restrictive. The scope of the present invention is indicated by the claims, and it is intended that all modifications within the meaning and scope equivalent to the claims are included in the present invention.

What is claimed is:

1. A last comprising:

an upper forming surface configured to form an upper including a wearing opening;

a base part that includes a bottom, the bottom having an upper surface and a lower surface, the lower surface being configured to define a bottom surface of the upper; and a plurality of additional parts, each of which is configured in a plate shape for assembly to the base part, wherein the base part further includes:

a first base member that includes a mounting unit configured to mount the plurality of additional parts such that the plurality of additional parts are arranged in a multi-layered configuration along one direction;

a second base member attachable to and detachable from the first base member; and a first forming surface that defines a first region of the upper forming surface, the plurality of additional parts includes a second forming surface defining a second region disposed at a location different from the first region in the upper forming surface while attached to the mounting unit, each of the additional parts has an end face, the second forming surface includes the end face of each of the plurality of additional parts, and the plurality of additional parts are separate from the bottom of the base part and extends in a downward direction to terminate at the upper surface of the bottom of the base part, such that the plurality of additional parts are spaced from the lower surface of the bottom of the base part and spaced from the bottom surface of the upper.

2. The last according to claim 1, wherein the first forming surface includes a wearing opening forming unit configured to form the wearing opening, the mounting unit includes a front mounting unit located in front of the wearing opening forming unit, the first base member includes the front mounting unit, and a boundary portion between the first base member and the second base member is defined at a position corresponding to the wearing opening in a height direction.

3. The last according to claim 2, wherein the front mounting unit includes a plurality of partition plates, each of which has a shape rising from the bottom and extending in a foot width direction, and the plurality of partition plates being arranged side by side at intervals in a foot length direction, and a distance between a pair of partition plates adjacent to each other in the foot length direction among the plurality of partition plates is set to allow each of the additional parts to be disposed between the pair of partition plates.

4. The last according to claim 3, wherein the front mounting unit further includes a rail that is connected to the plurality of partition plates and has a shape extending in the foot length direction, and a groove having a shape configured to receive the rail is in each of the additional parts.

5. The last according to claim 2, wherein the mounting unit further includes a rear mounting unit located behind the boundary portion between the first base member and the second base member, and the second base member includes the rear mounting unit.

6. A last comprising:

an upper forming surface configured to form an upper including a wearing opening;

a base part that includes a bottom, the bottom having an upper surface and a lower surface, the lower surface being configured to define a bottom surface of the upper; and a plurality of additional parts, each of which is configured in a plate shape for assembly to the base part, wherein the base part further includes:

a first base member that includes a mounting unit configured to mount the plurality of additional parts such that the plurality of additional parts are arranged in a multi-layered configuration along one direction;

a second base member attachable to and detachable from the first base member; and a first forming surface that defines a first region of the upper forming surface, the plurality of additional parts includes a second forming surface defining a second region disposed at a location different from the first region in the upper forming surface while attached to the mounting unit, each of the additional parts has an end face, the second forming surface includes the end face of each of the plurality of additional parts, the first forming surface includes a wearing opening forming unit configured to form the wearing opening, the mounting unit includes a front mounting unit located in front of the wearing opening forming unit, the first base member includes the front mounting unit, each of the additional parts configured to attach to the front mounting unit includes a bottom end face, the bottom end face of each of the plurality of additional parts attached to the front mounting unit defines a bottom surface of the upper together with the bottom of the base part, the second base member includes a rear mounting unit configured to mount a second plurality of additional parts behind the first base member, each of the second plurality of additional parts being configured in a plate shape for assembly to the second base member in a multi-layered configuration along one direction, and the second plurality of additional parts are separate from the bottom of the base part and extends in a downward direction to terminate at the upper surface of the bottom of the base part, such that the second plurality of additional parts are spaced from the lower surface of the bottom of the base part and spaced from the bottom surface of the upper.

* * * * *